US006675480B2

(12) United States Patent
Oswald

(10) Patent No.: US 6,675,480 B2
(45) Date of Patent: Jan. 13, 2004

(54) ELECTRIC SHAVER

(75) Inventor: Mathias Oswald, Werndorf (AT)

(73) Assignee: Payer Electroprodukte Ges.m.b.H., St. Bartholoma (AT)

( * ) Notice: Subject to any disclaimer, the term of this patent is extended or adjusted under 35 U.S.C. 154(b) by 50 days.

(21) Appl. No.: 09/936,326

(22) PCT Filed: Jan. 12, 2001

(86) PCT No.: PCT/AT01/00008

§ 371 (c)(1),
(2), (4) Date: Sep. 13, 2001

(87) PCT Pub. No.: WO01/51260

PCT Pub. Date: Jul. 19, 2001

(65) Prior Publication Data

US 2002/0157257 A1 Oct. 31, 2002

(30) Foreign Application Priority Data

Jan. 14, 2000 (AT) ..... 16/2000 U

(51) Int. Cl.[7] ..... B26B 19/04
(52) U.S. Cl. ..... 30/43.92; 30/527
(58) Field of Search ..... 30/43, 43.7, 43.8, 30/43.9, 43.91, 43.92, 346.51, 527

(56) References Cited

U.S. PATENT DOCUMENTS

| | | | | |
|---|---|---|---|---|
| 2,339,677 A | | 1/1944 | Burns | 30/43 |
| 5,564,191 A | * | 10/1996 | Ozawa | 30/43.92 |
| 6,301,786 B1 | * | 10/2001 | Oswald et al. | 30/43.92 |
| 6,357,118 B1 | * | 3/2002 | Eichhorn et al. | 30/43.92 |

FOREIGN PATENT DOCUMENTS

| | | |
|---|---|---|
| DE | 296 22 889 | 8/1997 |
| DE | 197 36 776 | 3/1999 |
| GB | 2 266 070 | 10/1993 |

* cited by examiner

*Primary Examiner*—Hwei-Siu Payer
(74) *Attorney, Agent, or Firm*—Kevin E Joyce

(57) ABSTRACT

The electric shaver comprises a housing in which an electric drive is arranged for the oscillating movement of cutting knives of a shearing head, wherein the shearing head is provided with at last two cooperating cutting elements driven so as to be relatively displaceable. A shearing head part (6) carrying at least one shearing blade (5) is hinged to be pivotal about at least one axis (8) differing from the direction of the oscillating movement of the cutting knives (11, 12) and extending in the direction of the longer axis of the housing, and is driven to perform a pivotal movement (9) about the axis (8).

8 Claims, 7 Drawing Sheets

ELECTRIC SHAVER

BACKGROUND OF THE INVENTION

1. Field of the Invention

The invention relates to an electric shaver including a housing in which an electric drive is arranged for the oscillating movement of cutting knives of a shearing head, wherein the shearing head is provided with at least two cooperating cutting elements driven so as to be relatively displaceable.

2. Prior Art

A dry shaver of the initially defined kind is known, for instance, from U.S. Pat. No. 2,339,677. In that configuration the cutter head, which is comprised of a cutter head base, an upper shear element and a lower shear element, is arranged on an upper housing surface of a housing so as to be reciprocally movable transverse to the direction of movement of a lower shear element driven to oscillate in the longitudinal direction. Driving is effected via a double eccentric. Another known configuration may be taken from DE-U 17 11 665. The driving element of the electric drive in that case is coupled to both the lower knife and the shearing head provided with an upper knife, via a transmission element such as, e.g., a toothed gearing or a double eccentric or a double lever, in order to set the lower knife and also the complete shearing head in motion. In the main, such a configuration requires a high-performance electromotor, which causes a higher storage capacity and, consequently, a smaller number of shavings per storage cell charge to be observed. From DE-A1 36 31 120 it is known to set reciprocally driven masses such as, for instance, eccentrics and coupling elements as well as lower knives into a dynamic equilibrium by means of eccentric pendulums in order suppress undesired oscillations. Also a configuration of that type calls for an increased power output of the electric drive. Finally, DE 197 36 776 C2 discloses a configuration in which the drive motor is elastically mounted and connected with a shearing-knife-carrying shearing head part via coupling rods. With such a configuration, the vibration of the motor is directly diverted to the drive of the shearing blade in addition to the oscillating shearing knife drive derived from the motor itself.

The drive of a shearing blade in the known configurations, thus, is effected relative to the oscillating knives either in the direction of the oscillation movement or substantially normal to said oscillation, which only insignificantly influences the cutting performance and the reliable seizure of hardly seizable hairs of a beard.

SUMMARY OF THE INVENTION

The invention aims to provide a device of the initially defined kind, which, in addition to increasing the cutting performance and reducing the sliding resistance of the shearing blade on the skin, also is to further enhance the reliable seizure of hardly seizable hairs of a beard. To solve this object, the configuration according to the invention essentially consists in that a shearing head part carrying at least one shearing blade is hinged to be pivotal about at least one axis differing from the direction of the oscillating movement of the cutting knives and extending in the direction of the longer axis of the housing, and is driven to perform a pivotal movement about said axis. Due to the fact that the additional movement of the shearing blade relative to the oscillating cutting knives occurs neither in the direction of the oscillating movement nor in a direction transverse thereto, but in a pivotal movement about a central axis, not only a considerable reduction of the sliding resistance is observed, but also the effect that, on account of the slanted position relative to the direction of movement of the shearing blade, which is predetermined by the user, even hairs that can hardly be seized or are only difficult to seize by conventional shavers will be safely seized at the oscillating movement about the central axis. In addition to a markedly improved handling comfort, the cutting performance is improved, too. This effect may be enhanced in that the shearing head part carrying at least one shearing blade is hinged to be pivotal about two crossing axes differing from the directions of the oscillating movements of the cutting knives.

Advantageously, the configuration according to the invention is devised such that the mounting of the shearing head part carrying the shearing blade is designed as a cardanic mounting, preferably a spherical head mounting. Such a spherical head mounting, in the main, provides a substantially better adaptation of the shearing blade to irregular skin contours and hence an enhanced cutting performance, which is assisted even further by the oscillating pivotal movement.

In a particularly simple manner, the pivotal drive of the shearing head part carrying the shearing blade may be derived from at least one oscillating knife via tilting levers pivotally mounted on the shearing head or on the housing, whereby, in order to impart a suitable oscillating pivotal movement about the central axis, the configuration advantageously is devised such that two tilting levers are arranged, in particular on the oppositely located longitudinal inner walls of the shearing head, which tilting levers are each coupled with one of the relatively counterdriven cutting knives or cutting knife blocks. Besides the substantially linear operating direction usually predetermined by the user through the guidance of the shaver over the skin, a pivotal movement transverse to the direction of displacement, thus, occurs again and again simultaneously during the linear displacement, said oscillating pivotal movement transverse to the direction of displacement offering the opportunity to further reduce the application pressure while, nevertheless, reliably cutting irregularly projecting hairs of a beard. The coupling and dimensioning of the tilting levers enables a relatively large oscillation stroke of the cutting knives to be reduced to a small pivoting angle so as to avoid any remarkable additional load on the drive.

In a structurally particularly simple embodiment, the configuration may be devised such that the tilting lever(s) is/are hinged to be pivotal about the shearing head pivot axis extending transverse to the oscillation direction of the cutting knives. By pivoting the complete cutting head transverse to the oscillation direction on the housing itself, the adaptation of the position of the shearing blade relative to the skin is further enhanced with an irregular skin contour, said pivot axis, at the same time, being usable in a particularly simple manner for the pivotal movement oscillating on the gear by appropriate arrangement of the tilting levers.

Advantageously, the configuration is devised such that the shearing head part carrying the shearing blade is pivotally hinged to a shearing head part that is detachably connected with the housing. In this manner, the free or damped pivotability of the shearing blade about an axis extending transverse to the oscillating pivotal movement will be ensured and the removal of the entire shearing head, for instance, for cleaning purposes will be facilitated. In a particularly simple manner, the configuration is devised such that the pivot axis extending in the direction of the longer axis of the housing is arranged to be offset eccentrically near a longitudinal inner wall, thus reducing the zone in which the perforations of the shearing head foil are imparted only a slight pivotal dislocation with the axis arranged centrally.

BRIEF DESCRIPTION OF THE DRAWINGS

In the following, the invention will be explained in more detail by way of exemplary embodiments illustrated in the drawing. Therein.

DETAILED DESCRIPTION OF PREFERRED EMBODIMENTS OF THE INVENTION

Figure 1:
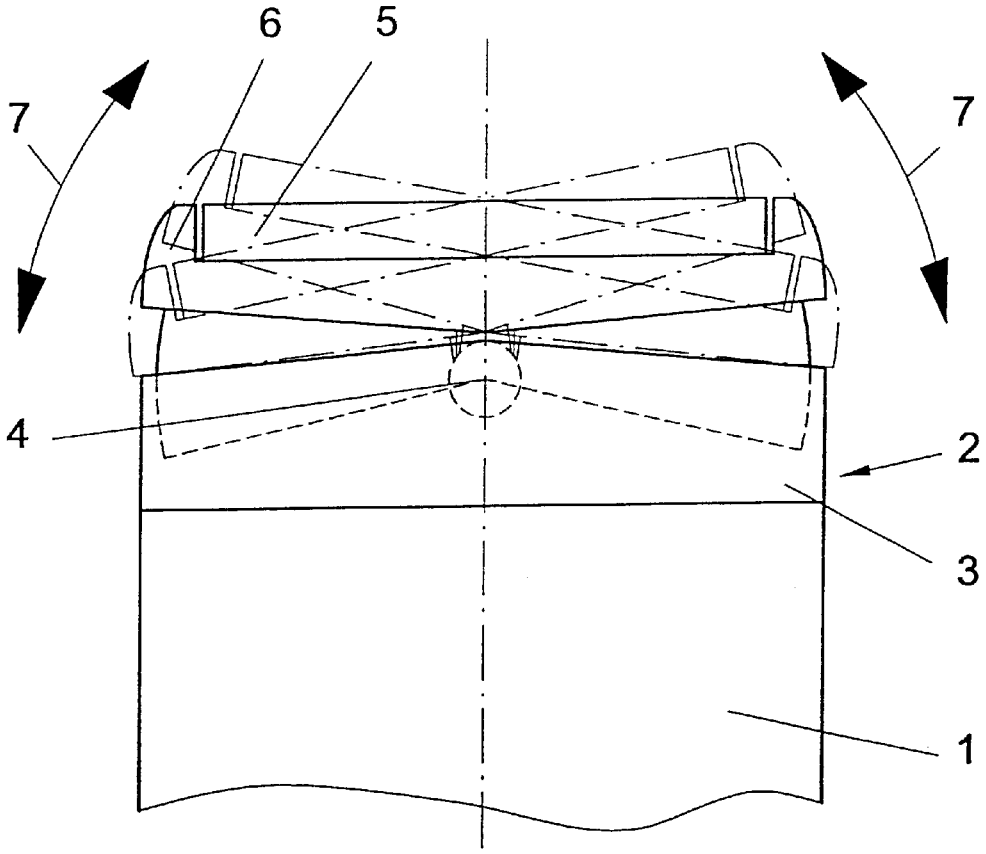
FIG. 1 is a front view of the head region of a shaver, from which the pivotability about an axis is apparent.
Figure 2:
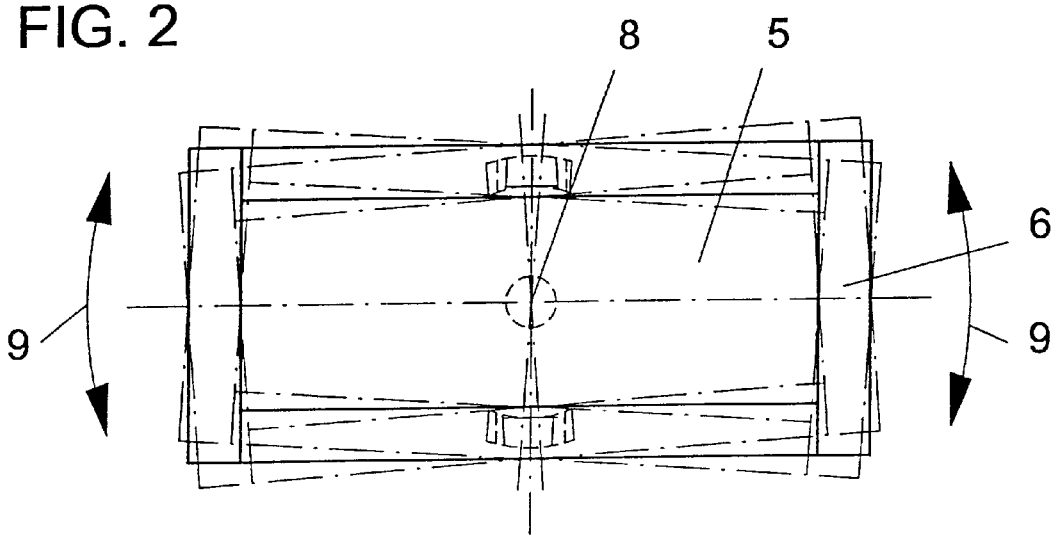
FIG. 2 is a top view on the configuration according to FIG. 1, illustrating the pivotal movement about the central axis.

In FIG. 1, the housing of a shaver is denoted by 1. To the housing is connected a two-part shearing head 2 whose head lower part 3 comprises a pivot axis 4 for the pivotal movement of a head part 6 carrying a shearing blade 5. The shearing head lower part in this case comprises a roof-shaped upper edge so as to ensure the free pivotability of the shearing blade 5 along with the shearing head part 6 carrying the shearing blade 5, in the direction of double arrows 7. From the top view according to FIG. 2, a central axis 8 is apparent, about which the shearing head upper part 6 is articulately connected together with the shearing blade 5 so as to be pivotal in the direction of double arrows 9.

Figure 3:
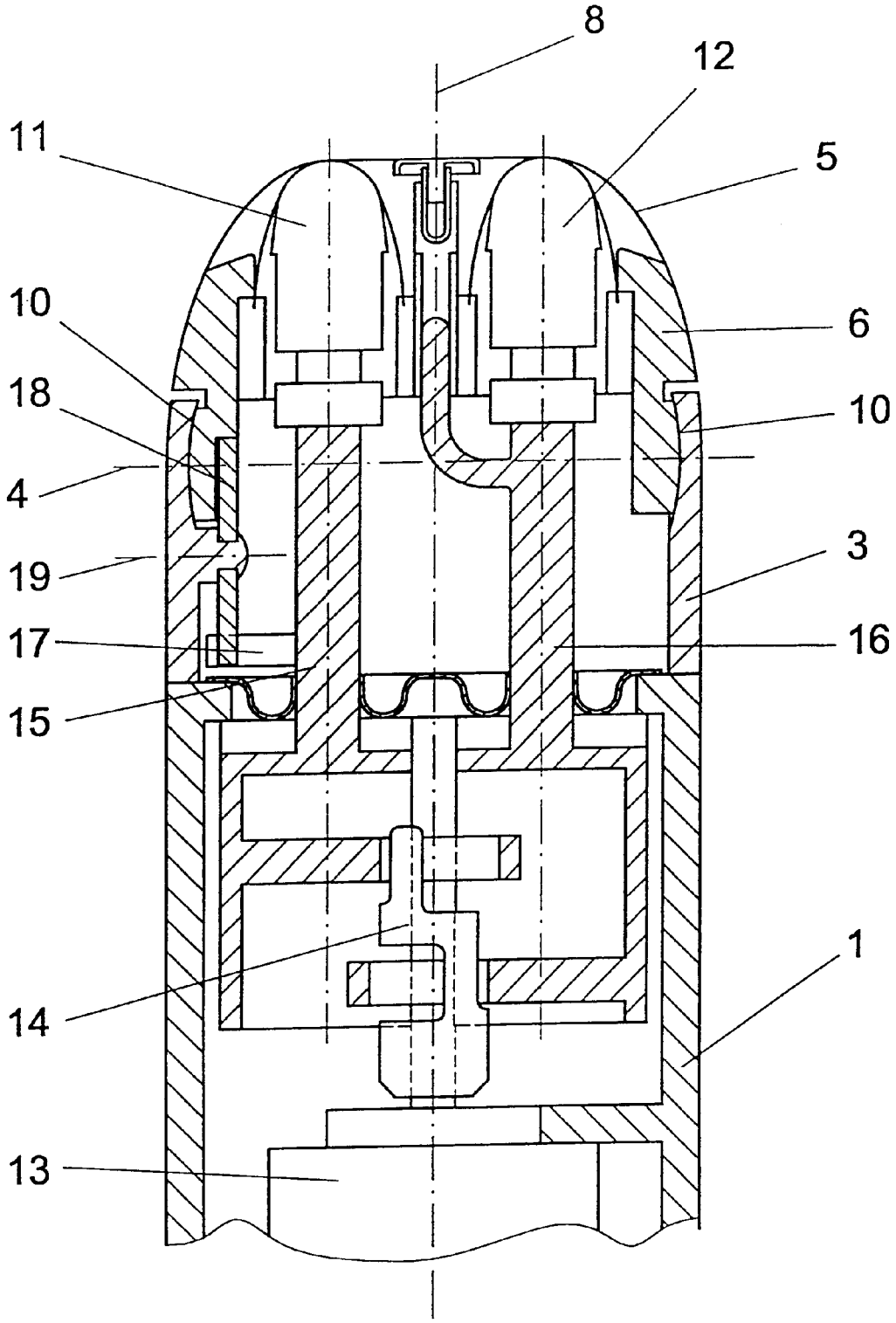
FIG. 3 illustrates a section through the head region of a first configuration of the pivotal head.

A technical design of such a central pivot axis 8 results, for instance, from the configuration according to FIG. 3. In FIG. 3, the shearing head upper part 6 carrying the shearing blade 5 engages in the shearing head lower part 3 via a ball-shaped bearing 10, said ball-shaped bearing 10 at the same time ensuring the pivotability of the shearing head upper part 6 about the axis 4 to be seen in FIG. 1. Yet, the ball-shaped configuration of this bearing also enables a pivotal movement about the central axis 8. The drive of the shearing knives 11 and 12, which are actuated to perform oscillating movements in opposite directions, is comprised of a motor 13 which, via a double eccentric 14, cooperates with respective coupling members 15 and 16, respectively, to drive the knives 11 and 12. The oscillating movement is tapped from the coupling member 15 by a lug 17 and transmitted to an angle lever 18 which is fixed in the shearing head lower part 3 so as to be pivotal about a pivot axis 19. During the oscillating movement of the coupling member 15, the pivoting lever 18 is, thus, each pivoted about the axis 19, whereby the shearing head upper part 6 may be pivoted in an oscillating manner about the axis 8 within the ball-shaped bearing 10 according to the illustration of FIG. 2, actuation being derived directly from the oscillations drive of a shearing knife.

Figure 4:
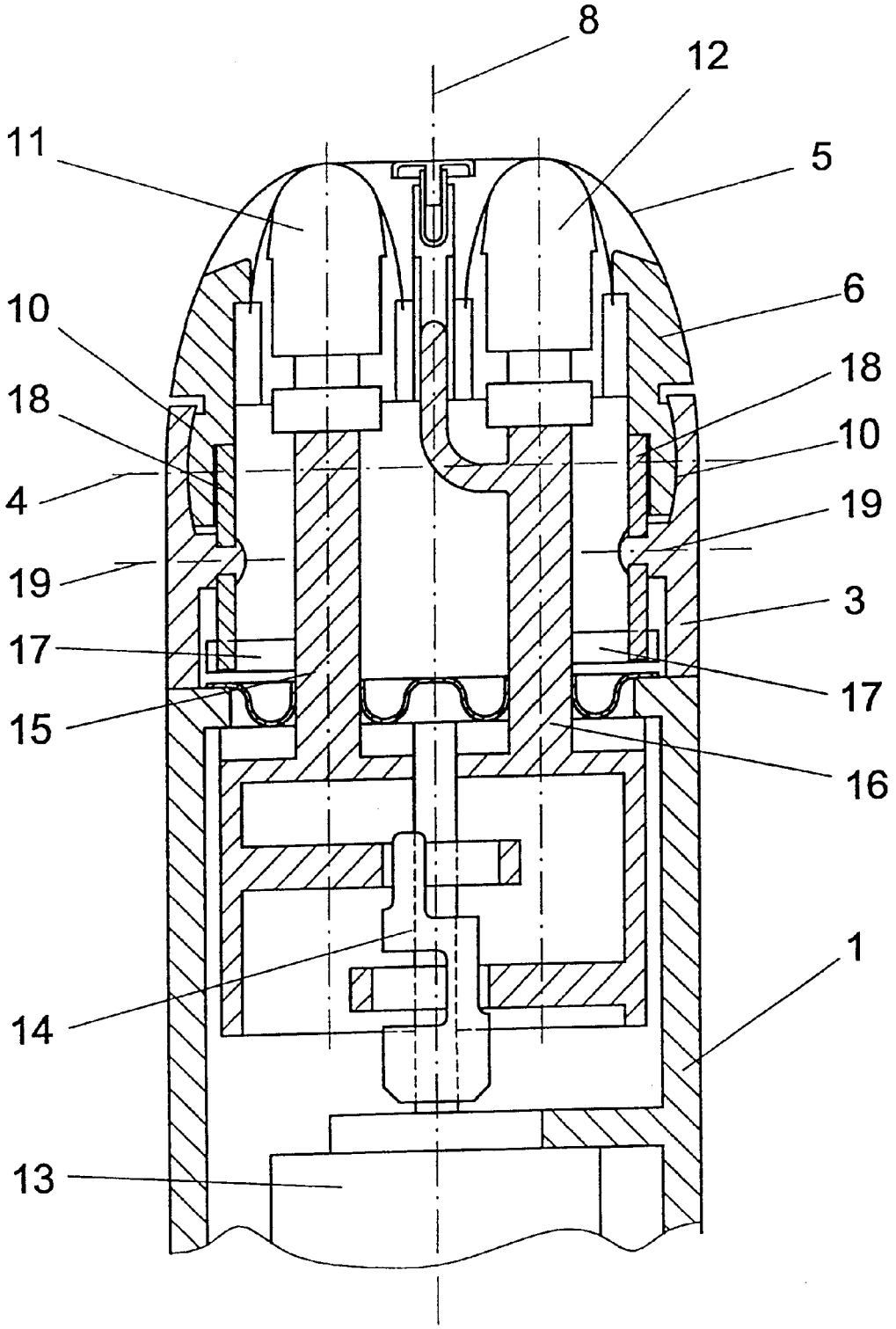
FIG. 4 is a section analogous to FIG. 3, through a modified embodiment.
Figure 5:
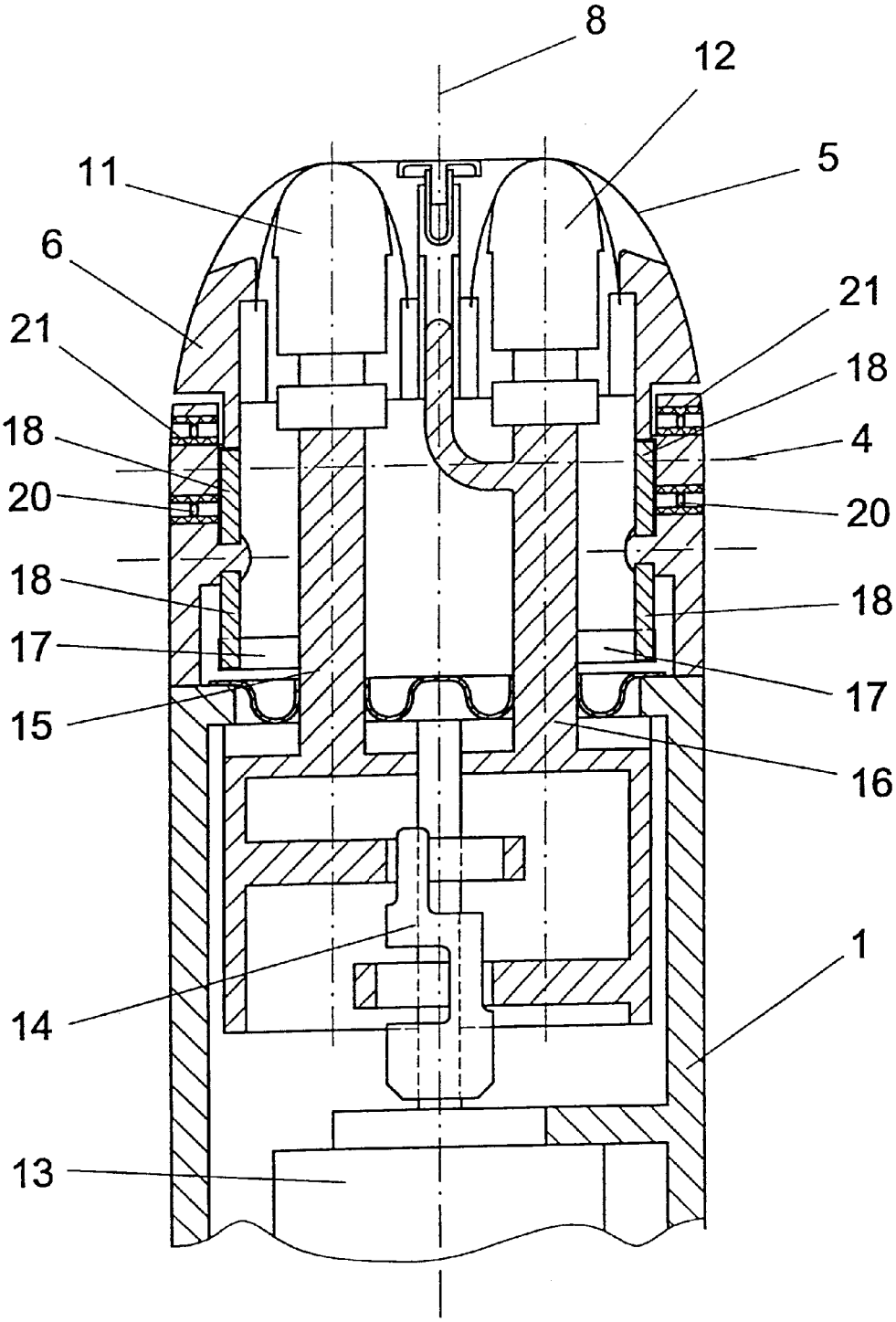
FIG. 5 is a sectional representation of a further modified embodiment analogous to FIG. 3.

In the embodiment according to FIGS. 4 and 5, identical structural components are denoted by the same reference numerals as in FIG. 3. The configuration according to FIG. 4 differs from the configuration according to FIG. 3 merely in that the pivoting levers 18 are each pivotally hinged about pivot axes 19 on two opposite sides of the shearing head lower part 3. Since the pivoting levers 18 via the respective lugs 17 each cooperate with the coupling members 15 and 16, which are driven in parallel, yet in opposite directions, the pivotal movement about the central axis 8 is further supported.

In the embodiment according to FIG. 5, the ball-shaped bearing is replaced with an elastic mounting through sealing elements 20 and 21. At a pivotal movement about the central axis 8 on account of the pivotal movement of the pivoting levers 18, these seals 20 and 21 are appropriately deformed so as to ensure, also in the instant case, a drive-derived oscillating pivotal movement about the central axis 8 in addition to the pivotability about the axis 4 as is apparent from FIG. 1.

Figure 6:
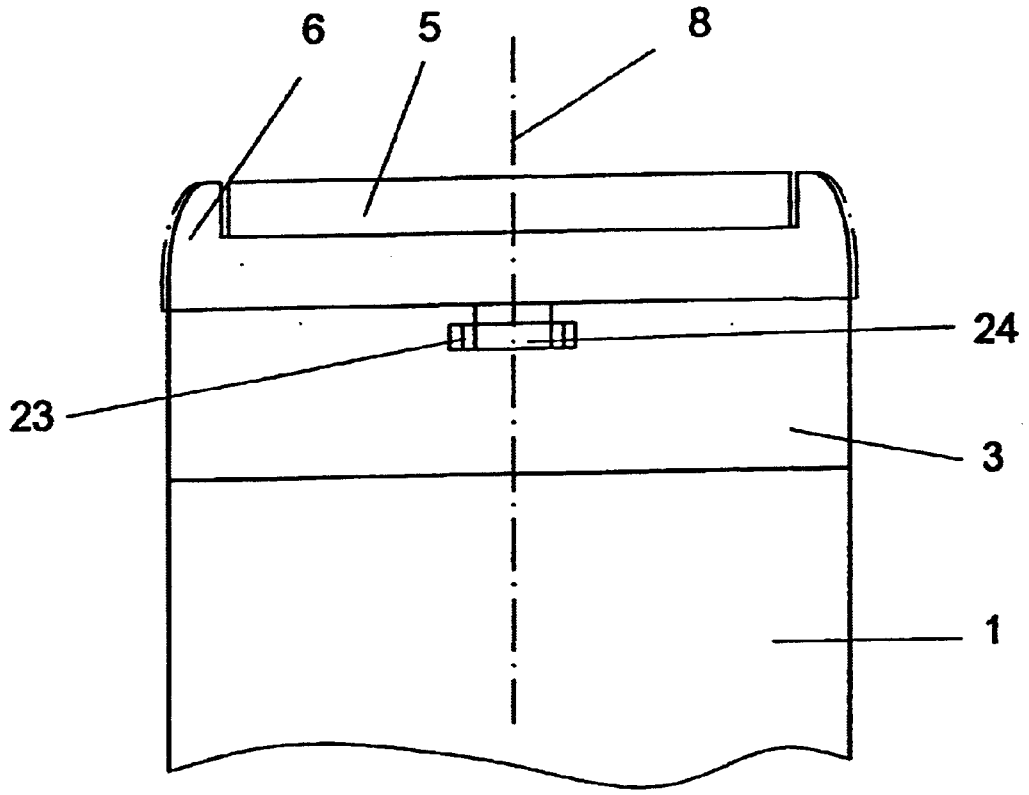
FIGS. 6, 7 and 8 show further embodiments in illustrations analogous to FIGS. 1 to 3, which provide pivotability only about the central axis.
Figure 7:
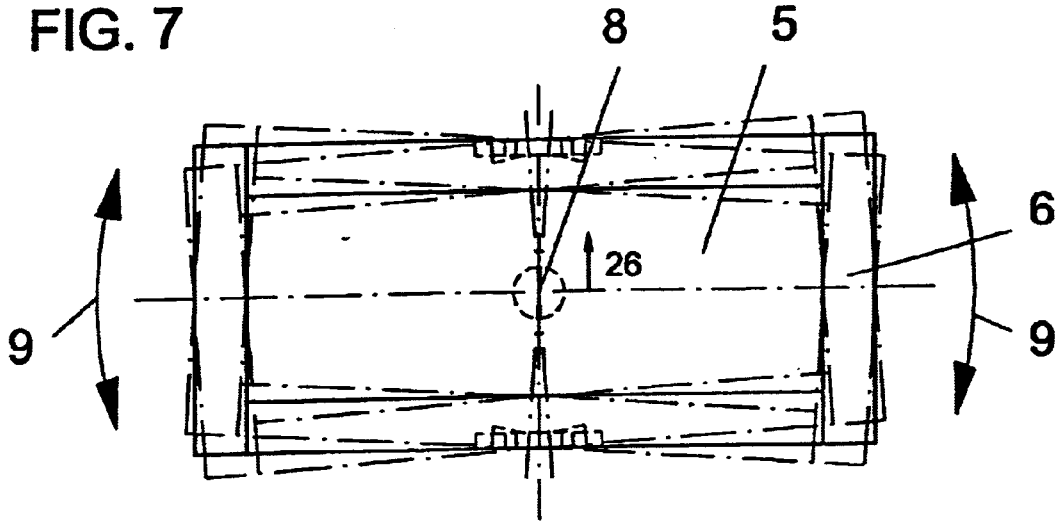
Figure 8:
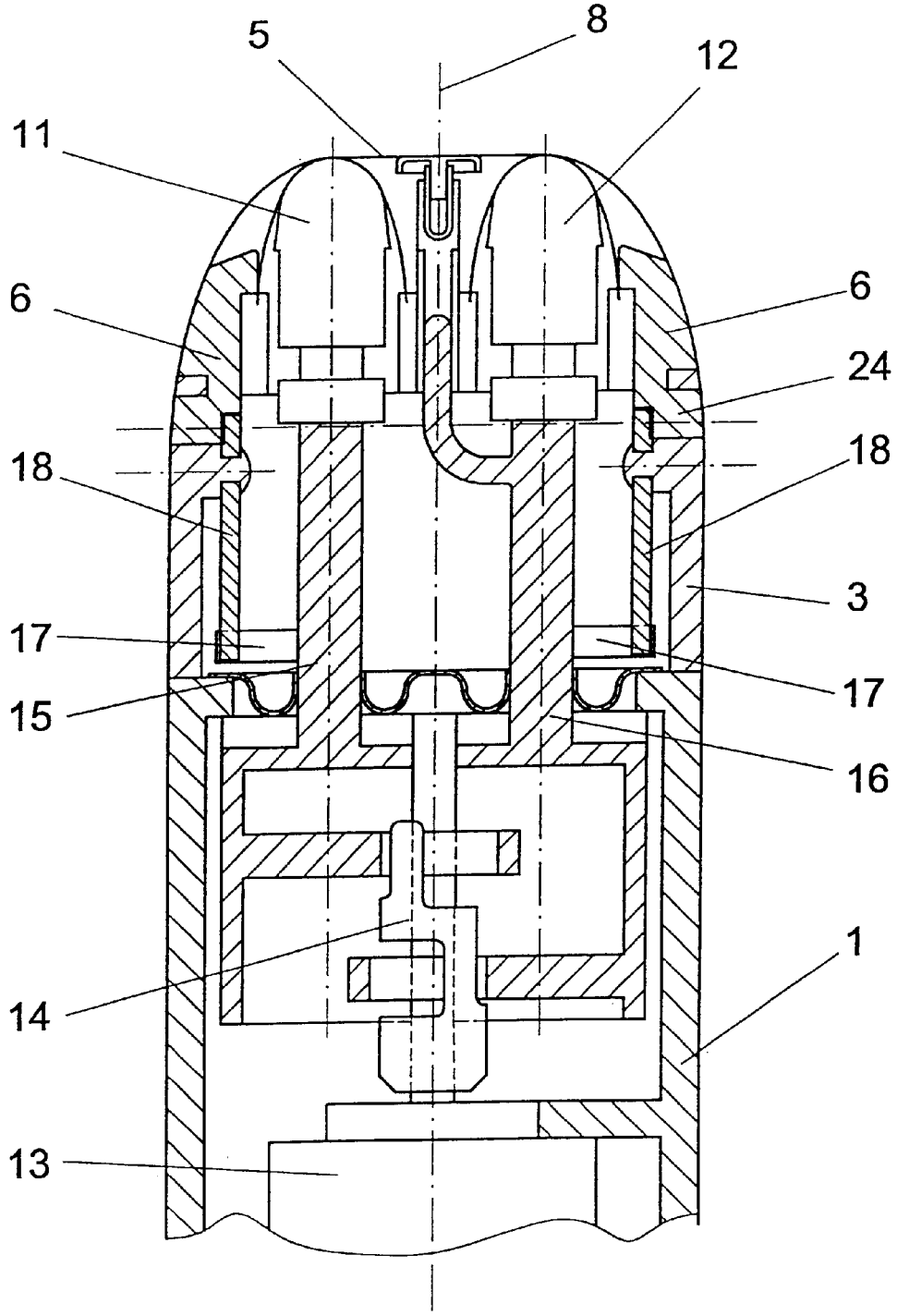

FIGS. 6, 7 and 8 depict an embodiment in which the pivotability about the axis 4 in the direction of the double arrow 7 has been obviated. As illustrated in FIG. 6, the shearing head upper part 6 is pivotal merely about axis 8, the pivotal movement being effected in a manner guided within a slot 23. A laterally cantilevering projection 24 which is pivotal about the axis 8 within the slot 23 during the pivotal movement of the pivoting levers 18 engages in this slot 23 of the shearing head lower part 3. The pivotal movement, thus, is effected exclusively about the central axis 8 in the sense of double arrow 9, as is apparent from FIG. 7.

Figure 9:
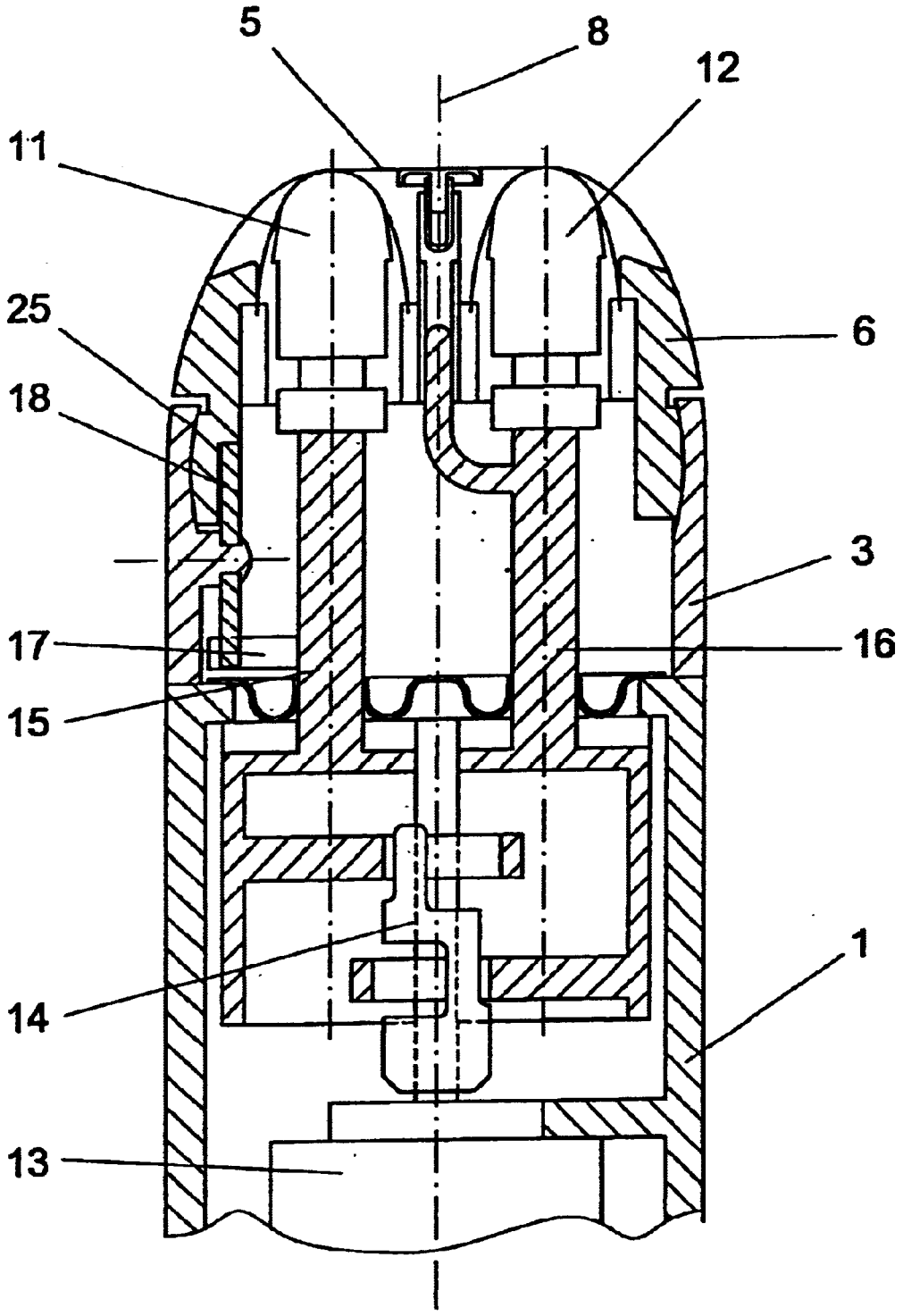
FIG. 9 is a sectional illustration of another embodiment, analogous to FIG. 8.

From the illustration according to FIG. 9, another modified embodiment is apparent, in which pivotability in the sense of double arrow 7 is likewise obviated. In the instant case, the articulation of the shearing head upper part 6 to the shearing head lower part 3 is realized via ball-shaped bearing surfaces 25, whereby pivoting is again provided exclusively about the central axis 8 by pivoting the tilting levers 18. The illustration according to FIGS. 6, 7 and 8 substantially corresponds to that of FIGS. 1, 2 and 3, whereas the illustration in FIG. 9 corresponds to the sections according to FIGS. 3, 4, 5 and 8. The reference numerals for identical parts have each been chosen to be the same.

The axis 8 need by no means be arranged centrally and, in a preferred manner, may be arranged to be offset in the sense of arrow 26 near a longitudinal inner wall of the housing as indicated in FIG. 7, whereby the number of shearing head foil perforations moved over a considerable pivoting course is increased.

What is claimed is:

1. An electric shaver including a housing in which an electric drive is arranged for oscillating movement of cutting knives of a shearing head, wherein the shearing head is provided with at least two cooperating cutting knives (11, 12) driven so as to be relatively displaceable, characterized in that a shearing head part (6) carrying at least one shearing blade (5) is hinged to be pivotal about at least one axis (8) differing from the direction of the oscillating movement of the cutting knives (11, 12) and extending in the direction of a longitudinal axis of the housing, and is driven to perform a pivotal movement (9) about said at least one axis (8).

2. An electric shaver according to claim 1, characterized in that the shearing head part (6) carrying the at least one shearing blade (5) is hinged to be pivotal about two crossing axes (4, 8) differing from the directions of the oscillating movement of the cutting knives.

3. An electric shaver according to claim 1 or 2, characterized in that a mounting (10) of the shearing head part (6) carrying the shearing blade (5) is designed as a gimbaled spherical head mounting.

4. An electric shaver according to claim 1 or 2, characterized in that a pivotal drive of the shearing head part (6) carrying the shearing blade (5) is derived for one of said at least two cooperating cutting knives (11, 12) via tilting levers (18) pivotally mounted on one of the shearing head (2) or the housing (1).

5. An electric shaver according to claim 4, characterized in that said tilting levers (18) comprise two tilting levers (18) arranged on oppositely located longitudinal inner walls of the shearing head (2), the tilting levers being respectively coupled with the cutting knives (11, 12) relatively counterdriven, or with cutting knife blocks.

6. An electric shaver according to claim 4, characterized in that the tilting levers (18) are hinged to be pivotal about a shearing head pivot axis (19) extending transverse to the direction of oscillating movement of the cutting knives (11, 12).

7. An electric shaver according to claim 1 or 2, characterized in that the shearing head part (6) carrying the shearing blade (5) is pivotally hinged to a shearing head part (3) that is detachably connected with the housing (1).

8. An electric shaver according to claim 1 or 2, characterized in that the said at least one axis (8) extending in the direction of the longitudinal axis of the housing is arranged to be offset eccentrically near a longitudinal inner wall of the housing.

* * * * *